United States Patent [19]

Shaub et al.

[11] Patent Number: 4,617,026

[45] Date of Patent: Oct. 14, 1986

[54] METHOD FOR IMPROVING THE FUEL ECONOMY OF AN INTERNAL COMBUSTION ENGINE USING FUEL HAVING HYDROXYL-CONTAINING ESTER ADDITIVE

[75] Inventors: Harold Shaub, Berkeley Heights; Walter E. Waddey, Westfield, both of N.J.

[73] Assignee: Exxon Research and Engineering Company, Florham Park, N.J.

[21] Appl. No.: 640,931

[22] Filed: Aug. 15, 1984

Related U.S. Application Data

[63] Continuation-in-part of Ser. No. 479,174, Mar. 28, 1983, abandoned.

[51] Int. Cl.[4] ..... C10L 1/18

[52] U.S. Cl. ..... 44/70

[58] Field of Search ..... 44/66, 70

[56] References Cited

U.S. PATENT DOCUMENTS

| | | | |
|---|---|---|---|
| 2,527,889 | 10/1950 | Moore et al. | 44/66 |
| 2,548,347 | 4/1951 | Caron et al. | 44/66 |
| 2,560,202 | 7/1951 | Zimmer et al. | 44/66 |
| 2,585,843 | 2/1952 | Rogers | 44/66 |
| 2,976,245 | 3/1961 | Copes | 44/66 |
| 3,047,373 | 7/1962 | McQuire | 44/66 |
| 3,542,678 | 11/1970 | Baork | 252/515 |
| 3,672,854 | 6/1972 | Rosenwald et al. | 44/66 |
| 3,672,854 | 6/1972 | Rosenwald et al. | 44/66 |
| 3,933,659 | 1/1976 | Lyle et al. | 252/32.7 E |
| 4,032,304 | 6/1977 | Dorer, Jr. et al. | 44/70 |
| 4,105,571 | 8/1978 | Shaub et al. | 252/32.7 E |
| 4,167,486 | 9/1979 | Rowe et al. | 252/56 R |
| 4,304,678 | 12/1981 | Schick et al. | 252/56 R |

FOREIGN PATENT DOCUMENTS

| | | |
|---|---|---|
| 2038355 | 7/1980 | United Kingdom . |
| 2038356 | 7/1980 | United Kingdom . |

*Primary Examiner*—Mrs. Y. Harris-Smith

*Attorney, Agent, or Firm*—Eugene Zagarella; Edward H. Mazer

[57] ABSTRACT

A method of reducing fuel consumption in an automotive internal combustion engine which comprises operating said engine on gasoline hydrocarbon fuel containing an effective fuel reducing amount of a selected additive which is a hydroxyl-containing ester of a monocarboxylic acid and a glycol or trihydric alcohol, said ester additive having at least one free hydroxyl group.

14 Claims, No Drawings

METHOD FOR IMPROVING THE FUEL ECONOMY OF AN INTERNAL COMBUSTION ENGINE USING FUEL HAVING HYDROXYL-CONTAINING ESTER ADDITIVE

CROSS-REFERENCE TO RELATED APPLICATIONS

This application is a Continuation-in-Part of Ser. No. 479,174 Mar. 28, 1983, now abandoned.

BACKGROUND OF THE INVENTION

This invention relates to a method for reducing the fuel consumption of an internal combustion engine.

There has been considerable effort in recent years to improve the fuel economy of motor vehicles. This effort has no doubt received impetus from the increasing public awareness of the need for energy conservation. Such need having developed from a combination of factors with the most significant being the unavailability of adequate fuel supplies during times of certain unsettling world events and the general increase in fuel prices over the past several years.

To date, the main approach to obtain improved fuel economy has been a mechanical one, i.e., smaller cars and smaller engines. Another approach to reduce fuel consumption which has received a fair amount of attention recently has been the development of lubricants that reduce engine friction and thus reduce energy requirements. Among the lubricating oils which have been developed to solve the problem of energy losses due to high friction are the synthetic ester base oils which are generally expensive. Other lubricating oils have incorporated additives to reduce overall friction. Some of the additives used in lubricating oils include the esters of fatty acid dimers and glycols as disclosed in U.S. Pat. No. 4,105,571, the esters of monocarboxylic acids and glycerol as disclosed in U.S. Pat. No. 4,304,678, the esters of dimer acids and monohydric alcohol disclosed in U.S. Pat. No. 4,167,486, the esters of glycerol and monocarboxylic fatty acids as disclosed in U.K. Pat. Nos. 2,038,355 and 2,038,356 and esters of monocarboxylic fatty acids and polyhydric alcohols disclosed in U.S. Pat. No. 3,933,659.

Another group of additives which has been used in lubricating oils to reduce friction are the molybdenum containing compounds including insoluble molybdenum sulfides, organo molybdenum complexes, e.g., molybdenum amine complexes disclosed in U.S. Pat. No. 4,164,473, molybdenum thio-bis phenol complexes disclosed in U.S. Pat. Nos. 4,192,753, 4,201,683 and 4,248,720, molybdenum oxazoline complexes disclosed in U.S. Pat. No. 4,176,074 and molydenum lactone oxazoline complexes disclosed in U.S. Pat. No. 4,176,073.

Some of the above friction reducing additives have been suggested for use in hydrocarbon compositions such as fuels and other additives have been suggested for use in hydrocarbon compositions such as fuels and lubricating oils to improve lubricity and load carrying properties. While many of such additives do in fact satisfy some of the property requirements as suggested, it is also known that in many instances other problems arise such as additive burn up and decomposition as fuels go through the combustion zone and the actual improvement in properties such as friction reduction and fuel economy never materializes. Therefore, the use of different additives in lubricating oils to reduce friction does not suggest a method of improving fuel economy by changing or adding materials to the fuel composition itself. Accordingly, there is the need for additional methods to improve the fuel economy of an internal combustion engine used to power automotive vehicles.

SUMMARY OF THE INVENTION

It has now been found that the fuel consumption of an automotive internal combustion engine can be reduced by using a petroleum hydrocarbon fuel which contains a major amount of gasoline and an effective amount of a selected additive which is an ester of a monocarboxylic acid and a polyhydric alcohol, said ester additive having at least one free hydroxyl group.

More particularly, this invention relates to a method of reducing the fuel consumption of an automotive internal combustion engine which comprises operating said engine on a hydrocarbon fuel containing a major amount of a liquid hydrocarbon of the gasoline boiling range and from about 0.001 to about 2% by weight, based on the total weight of the fuel, of an additive which is an ester of a monocarboxylic acid and a glycol or trihydric alcohol, said acid having about 12 to about 30 carbon atoms, said glycol being an alkane diol or oxa-alkane diol wherein said alkane is a straight chain hydrocarbon of about 2 to about 5 carbon atoms and said trihydric alcohol has a straight chain hydrocarbon structure of about 3 to about 6 carbon atoms, said ester additive having at least one free hydroxyl group, whereby said fuel including the ester additive effectively reaches the upper cylinder of said engine and thereby reduces the fuel consumed in the operation thereof.

DETAILED DESCRIPTION OF THE INVENTION

The present invention involves a method to improve the fuel economy of motor vehicles using an internal combustion engine wherein said engine is operated with a petroleum fuel containing a selected hydroxyl containing carboxylic acid ester additive.

The ester additive used in the method of this invention is generally derived from the esterification of a monocarboxylic acid and glycol or trihydric alcohol, said ester having at least one free hydroxyl group. More particularly, the ester additive used in this invention is a hydroxyl containing ester of a monocarboxylic acid and a glycol or trihydric alcohol, said acid having about 12 to 30 carbon atoms, said glycol being an alkane diol or oxa-alkane diol wherein said alkane is a straight chain hydrocarbon of about 2 to about 5 carbon atoms and said trihydric alcohol has a straight chain hydrocarbon structure of about 3 to about 6 carbon atoms.

The acid used in preparing the ester is an aliphatic, saturated or unsaturated, straight chained or branched monocarboxylic acid having about 12 to about 30, preferably about 14 to about 28, and more preferably about 16 to about 22 carbon atoms.

The alcohol used in preparing the ester additive of this invention is generally a saturated, straight chain, aliphatic, dihydric or trihydric alcohol. More particularly, the alcohol will be a glycol or diol, or a trihydric alcohol with said glycol being an alkane diol, i.e., alkylene glycol or oxa-alkane diol, i.e., polyalkylene glycol wherein said alkane is a straight chain hydrocarbon of about 2 to about 5 carbon atoms and said trihydric alcohol has a linear or straight chain hydrocarbon structure of about 3 to about 6 carbon atoms. The oxa-alkane diol (polyalkylene glycol) will contain periodically repeating groups of the formula:

$$HO\text{-}[RO]_x\text{-}H$$

where R is the alkane derivative defined above, i.e., a straight chain hydrocarbon of about 2 to about 5 carbon atoms with x being 2 to 100, more preferably 2 to 25. Preferably the alkane in said alkane diol or oxa-alkane diol will have about 2 to about 3 carbon atoms with ethylene glycol being the preferred alkane diol or alkylene glycol and diethylene glycol being the preferred oxa-alkane diol or polyalkylene glycol. Preferably the trihydric alcohol will contain about 3 to about 4 carbon atoms with glycerol being the preferred compound. Other compounds of this type which may be used in this invention are 1, 2, 6 trihydroxyhexane and 2, 2', 2'' nitrilotriethanol.

Further description and illustrations of the above-described acids and alcohols may be found in Kirk-Othmer "Encyclopedia of Chemical Technology," Second Edition, Volume 1, 1963, pp. 224–254 and 531–598.

The hydroxy-substituted ester additives used in this invention can be prepared by a variety of methods well known in the art. Such esters may be prepared from any of the acids and alcohols, as described above, and mixtures thereof. Preferably, the esters will be prepared from acids having about 14 to about 28 carbon atoms and trihydric alcohols. More preferably, the esters will be prepared from acids having about 16 to about 22 carbon atoms and glycerol. When using trihydric alcohols and particularly glycerol, some mono- and some diesters may be found in the ester mixture. Small minor amounts of triester may be present in the ester component, particularly in commerically available products, however, the ester additive will substantially comprise compounds having at least one free hydroxyl group. The ester additive used in this invention must be suitably soluble and compatible with the system, not provide any corrosion problems and, most important, must effectively reach remote areas of the automotive engine including the upper cylinder area to provide fuel economy benefits.

The fuel composition used in the method of this invention is generally a petroleum hydrocarbon fuel useful as a fuel or gasoline for internal combustion engines. Such fuels typically comprise mixtures of hydrocarbons of various types, including straight and branched chain paraffins, olefins, aromatics and naphthenic hydrocarbons. These compositions are provided in a number of grades and are typically derived from petroleum crude oil by conventional refining and blending processes such as straight run distillation, thermal cracking, hydrocracking, catalytic cracking and various reforming processes. Gasoline is defined as a mixture of liquid hydrocarbons or hydrocarbon-oxygenates having an initial boiling point in the range of about 70 to 135° F. and a final boiling point in the range of about 250° to 450° F., as determined by the ASTM D86 distillation method.

In general, the method of this invention will comprise the use of a petroleum hydrocarbon fuel or gasoline which contains an effective fuel reducing amount of the selected hydroxyl-containing ester of monocarboxylic acid and dihydric or trihydric alcohol. More particularly, the gasoline fuel will contain from about 0.001 to about 2% by weight of the ester additive and preferably from about 0.01 to about 1% by weight.

Other additives conventionally used in petroleum hydrocarbon fuels or gasoline may be included in the fuel used in the method of this invention, such as antioxidants, detergents, corrosion inhibitors, etc.

The following example is further illustrative of this invention and is not intended to be construed as a limitation thereof.

EXAMPLE 1

Fuel economy was measured using a Chevrolet 4.1 liter inline-6 engine on a dynamometer test stand with two different fuels, a standard reference gasoline and a test gasoline which was the same but contained 0.02 wt % of an ester additive. The ester additive was a mixture formed by the esterification of glycerol and oleic acid and comprised glycerol mono-oleate (55% by wt.) and glycerol di-oleate (45%). The fuels were run in the engine over two different time periods, i.e., 0.5 and 99 hours, and for four different load/cycle conditions.

The resulting fuel consumption for the 0.5 hour test was found to be 3.7, 1.7, 1.5 and 0.8% lower for the respective load/cycle conditions, for the fuel containing the ester additive than for the reference fuel without additive. The average weighted or global fuel consumption (i.e., based on fuel consumed for each load/cycle condition) was 1.5% lower for the ester additive containing fuel than the reference fuel without additive.

The resulting fuel consumption for the 99 hour test was 4.2, 2.9, 0.9, and 2.0% lower, for the respective load/cycle conditions, for the fuel containing ester additive than for the reference fuel without additive. The average weighted or global fuel consumption for this run was 2.2% lower for the ester additive containing fuel.

What is claimed is:

1. A method of reducing fuel consumption in an automotive internal combustion engine, which comprises operating said engine on a hydrocarbon fuel consisting essentially of a major amount of a liquid hydrocarbon of the gasoline boiling range, antioxidant, detergent, and/or corrosion inhibitor additive and from about 0.001 to about 2% by weight, based on the total weight of the fuel, of an additive which is an ester of an unsaturated monocarboxylic acid having about 12 to about 30 carbon atoms and a glycol or trihydric alcohol, said glycol being an alkane diol or oxa-alkane diol with said alkane being a straight chain hydrocarbon of about 2 to about 5 carbon atoms and said trihydric alcohol having a straight chain hydrocarbon structure of about 3 to about 6 carbon atoms, said ester having at least one free hydroxyl group, whereby said fuel including the ester additive effectively reaches the upper cylinder of said engine and thereby reduces the fuel consumed in the operation thereof.

2. The method of claim 1 wherein said acid has about 14 to about 28 carbon atoms.

3. The method of claim 2 wherein the alkane in the glycol contains about 2 to about 3 carbon atoms.

4. The method of claim 3 wherein said acid has about 16 to about 22 carbon atoms.

5. The method of claim 2 wherein trihydric alcohol is used to obtain said ester additive.

6. The method of claim 5 wherein said trihydric alcohol is glycerol.

7. The method of claim 6 wherein said acid has about 16 to about 22 carbon atoms.

8. The method of claim 1 wherein said fuel contains from about 0.01 to about 1% by weight of said ester additive.

9. The method of claim 8 wherein said acid has about 14 to about 28 carbon atoms.

10. The method of claim 9 wherein the alkane in the glycol contains about 2 to about 3 carbon atoms.

11. The method of claim 10 wherein said acid has about 16 to about 22 carbon atoms.

12. The method of claim 11 wherein trihydric alcohol is used to obtain said ester additive.

13. The method of claim 12 wherein said trihydric alcohol is glycerol.

14. The method of claim 13 wherein said acid is oleic acid.

* * * * *